US007296506B2

(12) United States Patent
Lindblom

(10) Patent No.: US 7,296,506 B2
(45) Date of Patent: Nov. 20, 2007

(54) MAKE-BREAK DEVICES

(75) Inventor: Victor E. Lindblom, Brooklyn Center, MN (US)

(73) Assignee: BAE Systems Land & Armaments L.P., Arlington, VA (US)

( * ) Notice: Subject to any disclaimer, the term of this patent is extended or adjusted under 35 U.S.C. 154(b) by 335 days.

(21) Appl. No.: 11/077,382

(22) Filed: Mar. 10, 2005

(65) Prior Publication Data

US 2006/0201317 A1 Sep. 14, 2006

(51) Int. Cl.
*F41A 3/00* (2006.01)
*F41A 9/00* (2006.01)

(52) U.S. Cl. ..... 89/22; 89/17; 89/33.01; 89/45

(58) Field of Classification Search ..... 89/17–25, 89/33.01, 45

See application file for complete search history.

(56) References Cited

U.S. PATENT DOCUMENTS 3,355,988 A * 12/1967 Giuliano ..... 89/45
3,537,353 A * 11/1970 Nelson ..... 89/20.2
4,462,299 A * 7/1984 Grunewald et al. ..... 89/24
4,508,006 A * 4/1985 Post et al. ..... 89/24
4,924,748 A * 5/1990 Breuer ..... 89/24
5,481,958 A * 1/1996 Balbo et al. ..... 89/45
5,675,108 A * 10/1997 Balbo et al. ..... 89/22
6,006,645 A * 12/1999 Breuer et al. ..... 89/24
6,186,041 B1 * 2/2001 Menges ..... 89/24
6,595,100 B2 * 7/2003 Breuer et al. ..... 89/24

* cited by examiner

*Primary Examiner*—Bret Hayes
(74) *Attorney, Agent, or Firm*—Patterson, Thuente, Skaar & Christensen, P.A.

(57) ABSTRACT

A make-break device includes a first component having at least one engaging member, the engaging member presenting first and second orthogonally disposed edges, each edge being defined at the intersection of a respective pair of chamfered face and a second component having at least one engaging member, the engaging member presenting first and second orthogonally disposed edges, each edge being defined at the intersection of a respective pair of chamfered faces, where the first component first edge and the second component first edge cooperatively act to assist in facilitating radial meshing engagement of the first and second components and where the first component second edge and the second component second edge cooperatively act to assist in facilitating axial meshing engagement of the first and second components. A cannon employing the make-break device and a method of selectively coupling/decoupling stationary electric drive assemblies from associated shiftable driven assemblies are included.

22 Claims, 17 Drawing Sheets

MAKE-BREAK DEVICES

RELATED APPLICATIONS

The present application is related to U.S. Provisional Application entitled VARIABLE VOLUME CHAMBER CANNON, Application No. 60/545,641, filed on Feb. 18, 2004, incorporated herein in its entirety by reference.

FIELD OF THE INVENTION

The present invention relates to automatic cannon and more particularly to cannon wherein isolating certain electronic components from the affects of recoil is desirable.

BACKGROUND OF THE INVENTION

While cannon of only a few decades ago were largely mechanical devices in which the crew performed the breech locking and unlocking operation and the ammunition loading and unloading operations, modern cannon are much more automatic in operation. Such automatic operations are necessary to achieve the rapidity of fire that is desired in modern cannon. In order to effect this rapidity of fire, electric and electronic devices perform many of the operations that were previously manually performed by the cannon crew. A problem that has arisen however is isolation of the electric and electronic devices from the severe acceleration affects of recoil of the cannon that occurs during firing of munitions from the cannon.

An exemplary modern cannon is disclosed in the related application noted above. This cannon requires electrical drives to raise the breech carrier and to operate the breech plug to both lock/unlock the breech plug and to translate the breech plug. The breech carrier and the breech plug lowers and raises for loading/unloading operations and then recoils aft when the cannon is fired. This creates two orthogonal axes of motion. The raising and lowering of the breech carrier is orthogonal with respect to the bore axis of the cannon. The recoil motion is parallel to or coincident with the bore axis of the cannon.

The electric drive assemblies (typically gearboxes) necessary to raise and lower the breech carrier and to operate the breech plug cannot long survive accelerations generated by the recoil of the cannon. Accordingly, it is desirable that the electric motors of the electric drive assemblies be mounted to the non-recoiling gun mount of the cannon as distinct from the recoiling breech carrier. In order to provide such isolation for the electric motors, the electric motors must include a device that readily disconnects the electric motor from the respective drives that are mounted on the breech carrier. The disconnect must be operable both axially and radially in order to accommodate both the raising and lowering of the breech carrier and the recoil of the breech carrier during gun firing. After a disconnect, the electric motor and its associated drive mechanism must then be readily and repeatably mated again for successive operations of the cannon.

SUMMARY OF THE INVENTION

The make-break devices of the present invention substantially meet the aforementioned needs of the industry by effecting repetitive making and breaking or engagement/disengagement of the non-recoiling electric motors from the respective recoiling drive mechanisms.

The make-break devices reliably transmit torque from the respective electric motor to its associated drive when engage therewith. The make-break device allows for both axial and radial disconnection of the electric motor from its associated drive in order to accommodate for the motion of recoil (axial) and for transverse breech carrier motion (radial). The make-break devices allow reconnection of the electric drive motors and the respective drive mechanisms while remaining accurately timed. Additionally, the make-break devices are designed to minimize backlash and to accommodate sufficient parallel and angular misalignment to accommodate manufacturing tolerances and carriage clearance and yet still reliably and repeatably re-engage. The make-break devices further accommodate including minimal controls and brakes for holding the position of input and output devices in order to minimize the affects of rotational misalignment. Additionally, the make-break devices accommodate gross rotational misalignment that might result from control failure without destroying the joint or adjacent components, thereby allowing the cannon to return safely to battery or the breech carrier to return safely to the firing position.

The make-break devices of the present invention enable simple, efficient, automation of a large caliber cannon system and contribute to increased system reliability and effectiveness. Reliability is a key concern for automated cannon and high relates of fire are critical to future cannon system effectiveness. The present invention directly contributes to both reliability and to a high rate of fire, and hence, contributes to improve system effectiveness.

The present invention is a make-break device that includes a first component having at least one engaging member, the engaging member presenting at least first and second orthogonally disposed edges, each edge being defined at the intersection of a respective pair of chamfered face and a second component having at least one engaging member, the engaging member presenting at least first and second orthogonally disposed edges, each edge being defined at the intersection of a respective pair of chamfered faces, where the first component first edge and the second component first edge cooperatively act to assist in facilitating radial meshing engagement of the first and second components and where the first component second edge and the second component second edge cooperatively act to assist in facilitating axial meshing engagement of the first and second components. The present invention is further a cannon employing the make-break device and a method of selectively coupling/decoupling respective stationary electric drive assemblies from associated shiftable driven assemblies during orthogonal operations.

DETAILED DESCRIPTION OF THE DRAWINGS

Figure 1:
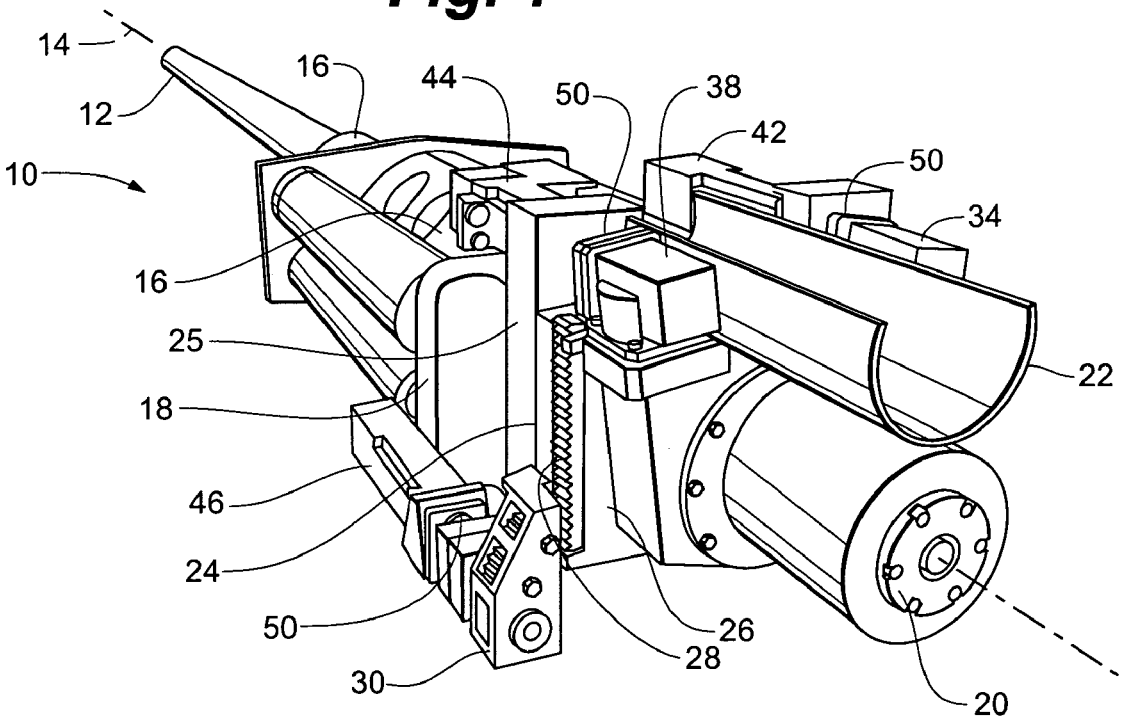
FIG. 1 is a perspective left rear quarter view of an exemplary cannon employing a plurality of make-break devices of the present invention.
Figure 2:
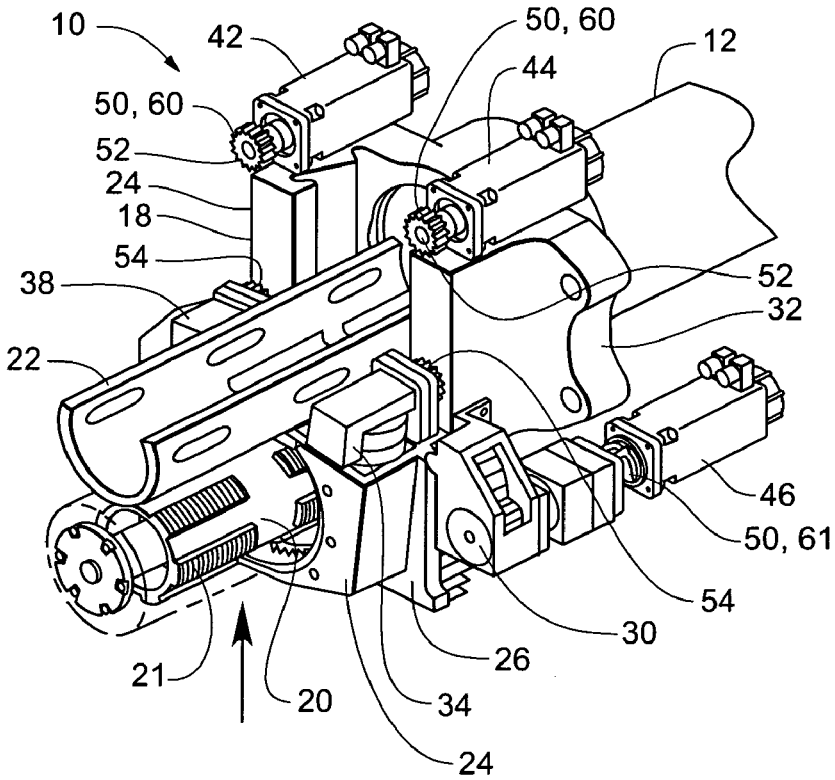
FIG. 2 is a perspective view of a portion of the cannon of FIG. 1 with the breech carrier in the lowered, loading disposition.
Figure 3:
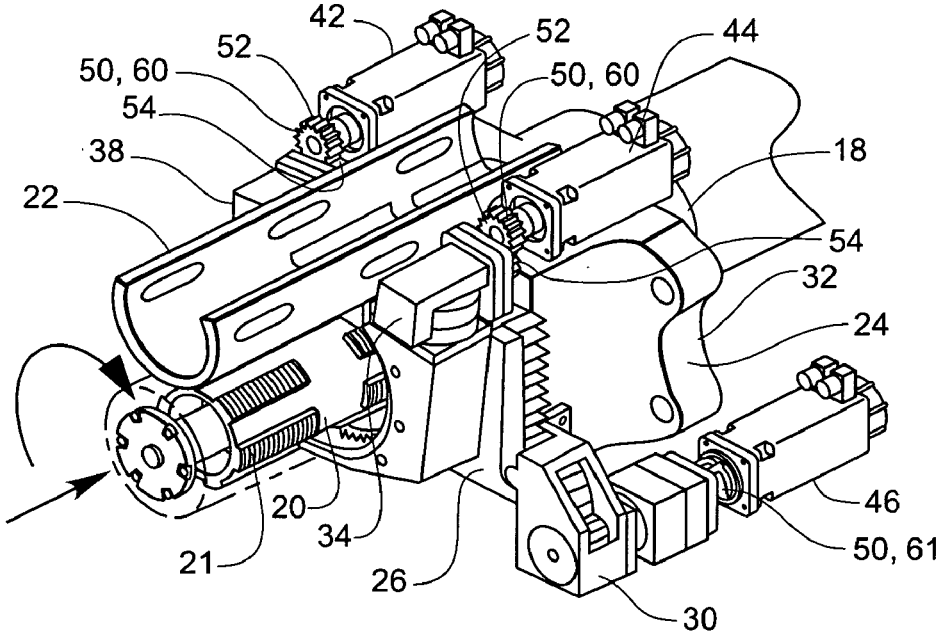
FIG. 3 is a perspective view of a portion of the cannon of FIG. 1 with the breech carrier in the raised, closed disposition.

An exemplary cannon imploring a plurality of make-break devices of the present invention is shown generally at 10 and FIG. 1. It is understood that other cannon, particularly automated cannon, could also utilize the make-break devices of the present invention.

The cannon 10 includes an elongated tubular barrel 12 having a centrally defined bored axis 14. A chamber 16, having a generally increased diameter relative to the diameter of the barrel 12, is disposed proximate the breech end of the barrel 12.

A breech assembly 18 is disposed rearward of the chamber 16. The breech assembly 18 includes a breech plug 20 that is disposable and lockable at selected positions (depths) within the chamber 16 in order to vary the volume of the chamber 16. In the minimum volume disposition, the rearward end of the breech plug 20 is substantially flush with the breech end of the chamber 16. In the maximum volume disposition, the rearward end of the breech plug 20 projects substantially rearward relative to the breech end of the chamber 16 and only a relatively small portion of the breech plug 20 is disposed in the chamber 16.

The breech assembly 18 further includes a load tube 22 that is disposed generally above the breech plug 20. The load tube 22 is translatable up and down relative to the bore axis 14 in conjunction with the breech plug 20 for conveying munitions to the chamber 16 when in the lowered disposition.

The breech plug 20 and load tube 22 are translatable up and down by being mounted on a suitable breech block 24. The breech block 24 has a bore defined therein that is in registry with the bore of the barrel 12 when the breech block 24 is in the battery (raised) disposition.

An interrupted thread gear 21 is disposed on the outer margin of the breech plug 20. A corresponding interrupted thread gear 26 is disposed on the inner wall of the bore defined within the breech block 24. The thread gear 26 mates with interrupted threads 21 defined on the exterior margin of the breech plug 20 in order to lock the breech plug 20 into a desired (and variable) position relative to the chamber 16.

The breech block 24 is actuated up and down by a pair of laterally spaced apart breech carrier gear racks 28. Each of such gear racks 28 has a plurality of teeth defined thereon. The breech block 24 rides up and down within tracks defined within a stationary breech ring 25. The breech ring 25 is fixedly mounted. The breech ring 25 neither translates up and down during loading operations, but the breech ring 25 does recoil with the barrel 12, being affixed to the barrel 12.

A breech carrier gear box 30 on either side of the breech assembly 18 is coupled to a respective breech carrier gear rack 28. The gears of the breech carrier gearbox 30 are meshed with the respective gear rack 28 for positively driving the breech block 24 between the lower load disposition and the raised, closed disposition.

Figure 4:
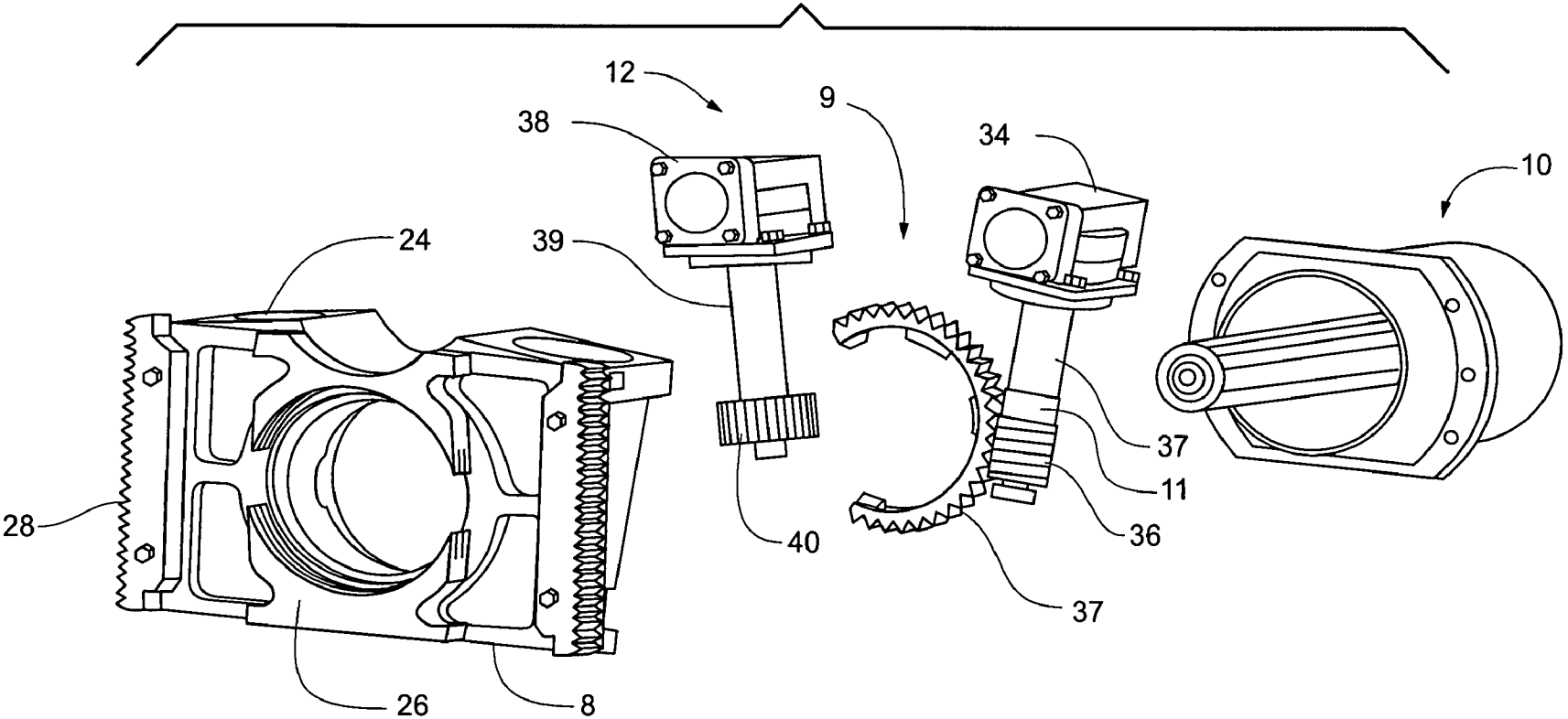
FIG. 4 is an exploded view of certain components of the breech of the cannon.
Figure 5:
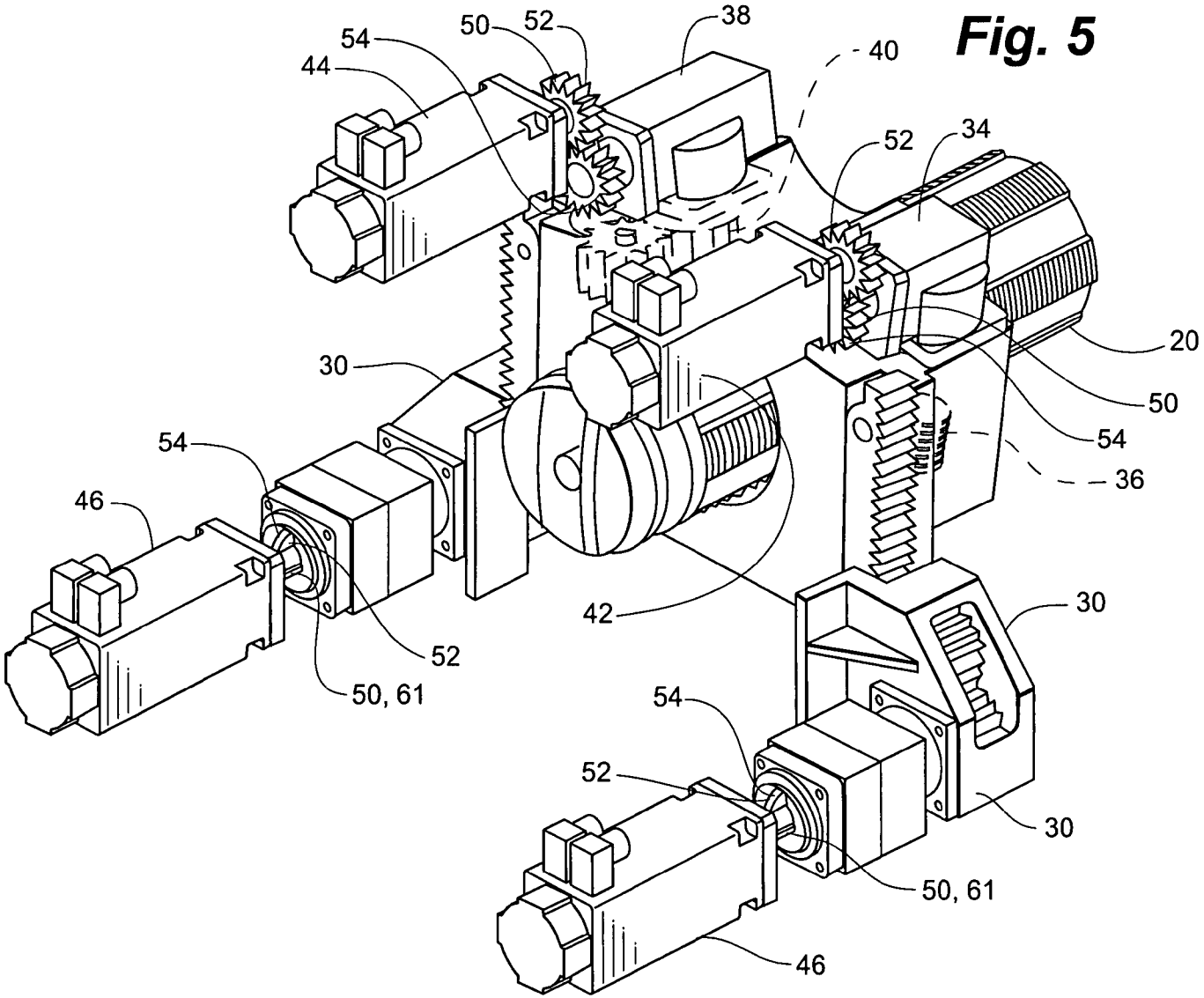
FIG. 5 is a perspective view of certain components of the cannon depicting the drive components of the breech.
Figure 6:
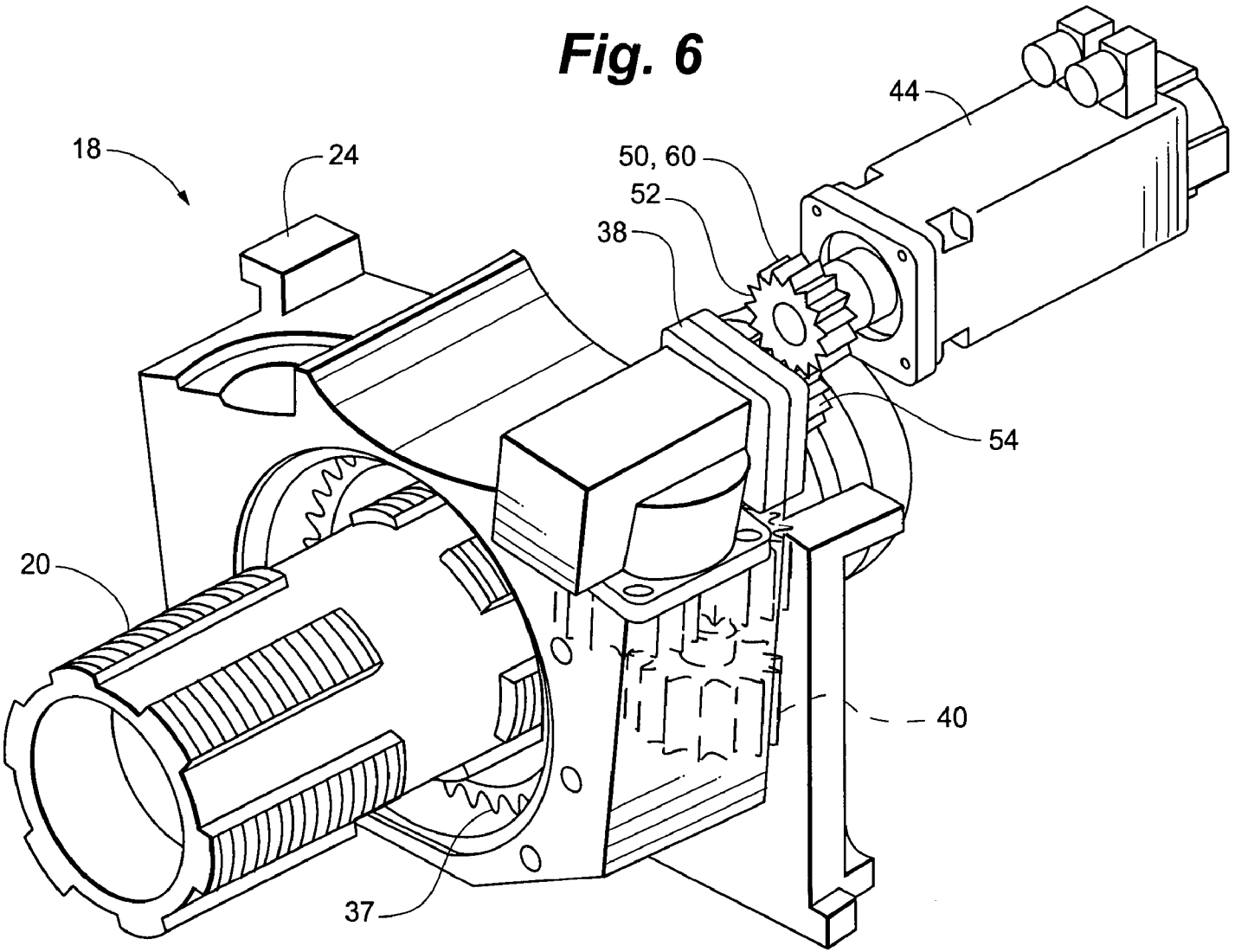
FIG. 6 is a perspective view of the translational drive components of the chamber plug.
Figure 7:
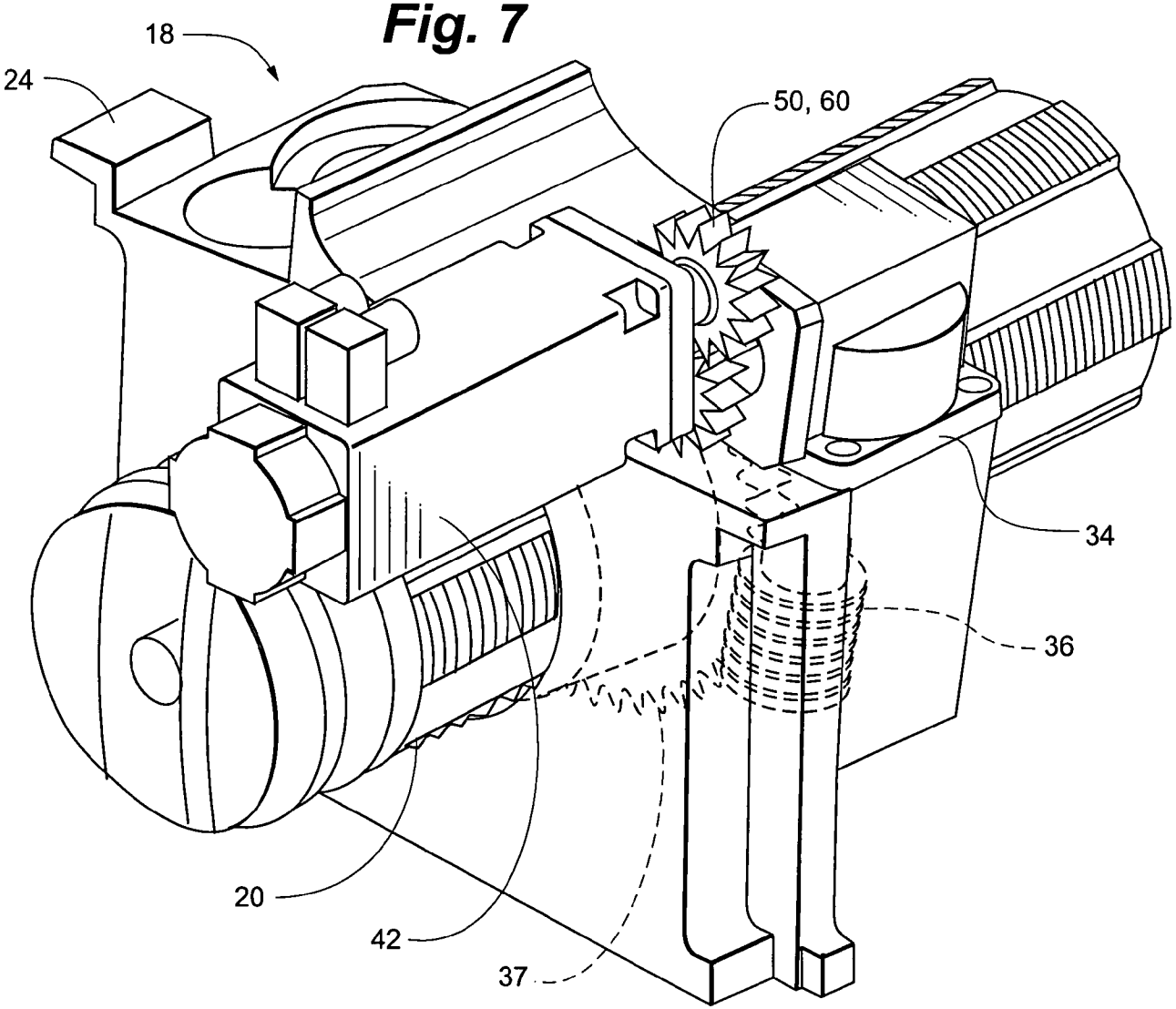
FIG. 7 is a perspective view of the locking components of the breech plug.

Referring FIG. 4, there are two further gear assemblies mounted proximate the top of the breech assembly 18. The first such gear assembly is a locking gear assembly 34. The locking gear assembly 34 has a depending shaft 35 that is coupled to a worm gear 36. The worm gear 36 is engaged with a locking gear 37. The locking gear 37 is preferably coupled to the breech plug 20. Rotational actuation of the locking gear 37 by the locking gear assembly 34 acts to rotate the breech plug 20 to either engage or disengage the interrupted threads 21 on the exterior margin of the breech plug 20 with the interior interrupted threads 26 of the breech block 24, thereby locking and unlocking the breech plug 20 in the chamber 16.

A second gear assembly located proximate the top of the breech assembly 18 is the translate gear assembly 38. The translate gear assembly 38 has a depending shaft 39 coupled to a pinion gear 40. The pinion gear 40 is designed to mesh with the interrupted threads on the external margin of the breech plug 20. The actuation of the pinion gear 40 translates the breech plug 20 axially with respect to the chamber 16 to clear the breech plug 20 rearwardly of the chamber 16 and the breech assembly 18. Once so cleared, the breech plug 20 can be lowered as noted above for loading ammunition by bringing the load tube 22 into alignment with the chamber 16.

All of the aforementioned gear assemblies are actuated by electric drive motors. Accordingly, on the exemplary cannon 10 there are four electric drive motors. The first two electric drive motors 42, 44 drive the locking gear assembly 34 for locking/unlocking the breech plug 20 in the chamber 16 and the translate gear assembly 38 for translating the breech plug 20 relative to the chamber 16, respectively. The second two electric drive motors 46 drive the respective breech carrier gear boxes 30. Each of the four gearboxes, 34, 38, and the two breech carrier gear boxes 30, recoils with the barrel 12 of the cannon 10 during firing operations of the cannon 10. Each of the electric drive motors 42, 44 and both the electric drive motors 46 are fixed and do not translate with the barrel 12 of the cannon 10 under recoil in order to isolate the more delicate electric drive motors 42, 44, and 46 from the accelerations imposed by the recoil of the cannon 10. Accordingly, there is a need to repetitively engage and disengage the respective electric drive motors 42, 44, and 46 with their respective gearboxes 30, 34, and 38. The make-break device 50 of the present invention provides such repetitive engage and disengage function both radially and axially.

Referring to FIGS. 10-13, the make-break device 50 is generally comprised of two members, a first member of the pair being a driving component 52 and a second member of the pair being a driven component 54. The driving component 52 is operably coupled to one of the drive motors 42, 44, or 46. The driven component 54 is operably coupled to one of the gear assemblies 30, 34, or 38. The make-break device 50 depicted in FIGS. 10-13 is a first embodiment of the present invention and is a gear type make-break type device 60. In a preferred embodiment, the driving component 52 and the driven component 54 of the gear type make-break device 60 are identical. This need not be the case as one of the components 52, 54 could have more teeth 70 than the other component and the gear body 62 of each of the components 52, 54 could have different structural characteristics. The driving component 52 and the driven component 54 of the gear type make-break device 60 are axially offset when coupled with teeth 70 engaged.

The driving component 52 and the driven component 54 of the gear type make-break device 60 each includes a gear body 62. The gear body 62 has a tubular exterior margin and, in an embodiment, has a circlip groove 63 defined therein. An axial bore 64 extends through the gear body 62. A keyway 66 is defined in the axial bore 64 for coupling the make-break device 60 to respective shafts.

A gear head 68 extends radially outward from the exterior margin of the gear body 62. The gear head 68 has a plurality of teeth 70 formed thereon. Each of the teeth 70 has a generally flat backside margin 72. The teeth 70 are radially disposed with respect to a bore axis 74. The structure of the teeth 70 is symmetrical about a plane including the bore axis 74 and the radius 76, coincident with the axial leading edge 96. As will be discussed in greater detail below, each of the teeth 70 is specially modified with respect to the teeth of a conventional spur gear. A sharp edge 80, 96 each flanked by chamfered sides is presented both radially and axially to maximize the possibility of radial and axial engagement of the teeth 70 of the driving component 52 with the teeth 70 of the driven component 54. Accordingly, the teeth 70 of the present invention lack the top land, face, and bottomland of a conventional spur gear.

As noted above, each of the teeth 70 has a radial leading edge 80. The radial leading edge 80 is flanked by primary guide faces 82 on either side thereof that are chamfered with respect to the radial leading edge 80. In a preferred embodiment, the primary guide faces 82 are flat faces. The intersection can be blended rather than meeting at a sharp edge.

A clearance chamfer 84 extends outward from the maximum radial point of the radius leading edge 80 at an angle toward the flat back side margin 72. The clearance chamfer 84 in a preferred embodiment forms a generally diamond shaped hexagon. In the preferred embodiment, the clearance chamfer 84 is a flat surface, but a curved surface could be employed as well. A curved generally U shaped tapering face 86 extends rearward from and at an angle to the front margin 87 of adjacent teeth 70 of the gear type make-break 60. The curved tapering face 86 intersects the curved root 88 between the adjacent pairs of teeth 70.

An addendum 90 (the radial distance between two concentric circles on a gear, one being that whose radius extends to the top of the gear tooth, defined by the radial edge 80, and the other being that which will roll without slipping on a circle on a mating gear) is a modified form of a conventional gear in that the addendum 90 is increased more than the addendum of a standard spur gear to create an edged tooth for smooth radial engagement, and the dedendum 92 (the difference between the radius of the pitch circle of the gear and the radius of the gear root circle) is decreased more than the dedendum of a standard spur gear to prevent interference at the root 88. The addendum and the dedendum together preferably define an involute tooth surface 94. When driving through the gear joint, involute tooth surface 94 of the driving component 52 and the meshed involute tooth surface 94 of the driven component 54 contact like a standard spur gear.

The exemplary gear type make-break devices 60 of the present invention have 14 teeth and four marginal for a 56-millimeter pitch diameter. It should be noted that the make-break device 60 is not constrained to these values.

Figure 16:
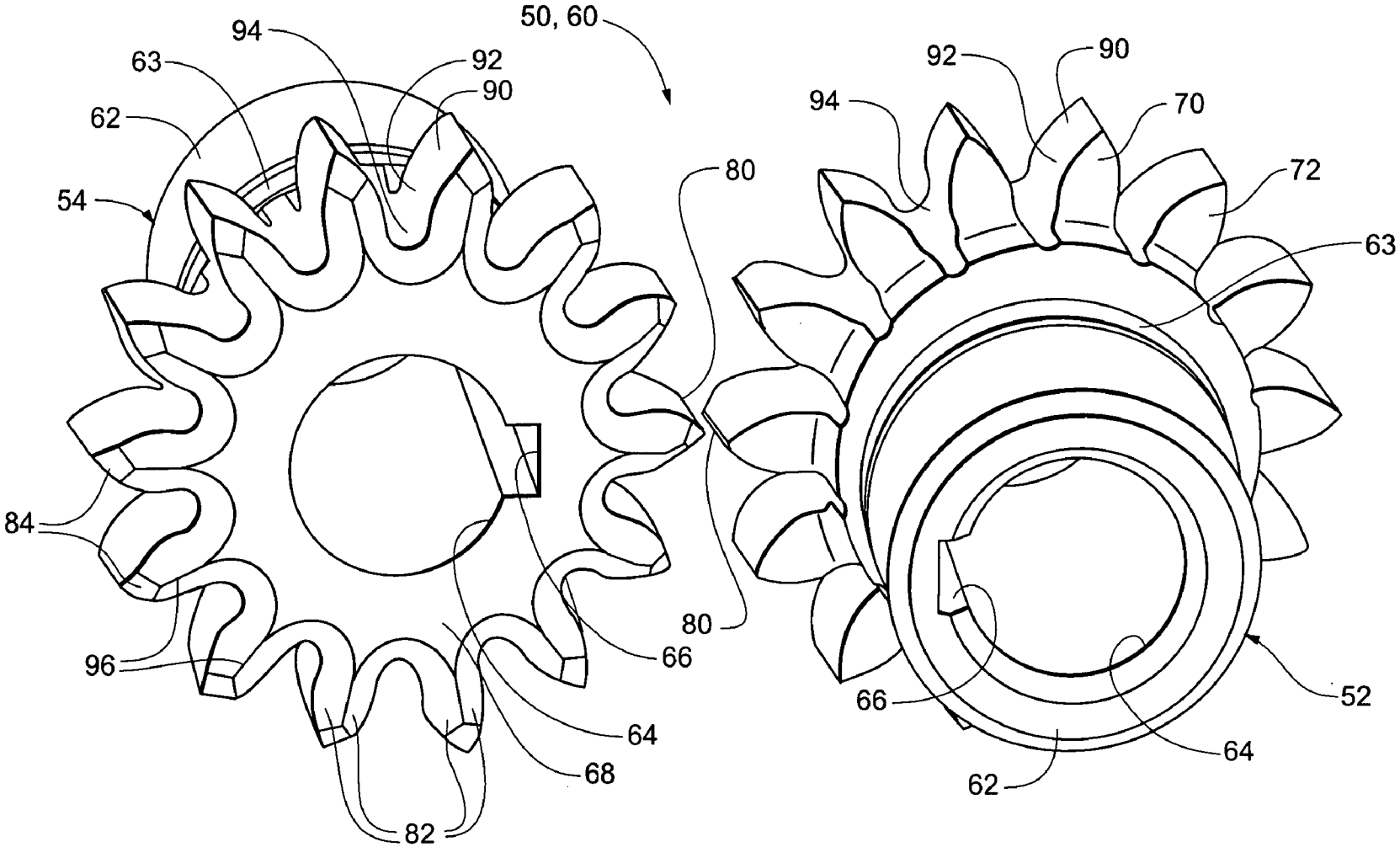
FIG. 16 is a perspective view of tooth to tooth radial presentation of a gear make-break device.

In the case of radial engagement (transverse engagement relative to the bore axis 14) as depicted in FIG. 16, a space between adjacent teeth 70 of the driving component 52 and a tooth 70 of the driven component 54 are presented to each other with various degrees of misalignment. At extreme misalignment, the radial leading edge 80 of the engaging tooth 70 will slide along the chamfer extending radially inward from the radial leading edge 80 that is presented by the involute tooth surface 94 of the tooth 70 of the driving component 52, 54 being engaged. This action causes the engaging teeth 70 and the respective components 52 and 54 to self align into proper mesh even when presented in a condition of misalignment. The design of teeth 70 as noted immediately above results in proper engagement whether a single tooth 70 on a first gear-type make-break device 60 is presented to a single tooth 70 on a second gear-type make-break device 60 or whether a tooth 70 on a first make-break device 60 is presented to a space on a second make-break device 60. The geometry of the teeth 70 allows for an error equal to substantially one half the angular tooth spacing of the gear type make-break device 60 and will still engage properly. Such design facilitates the repeatable coupling necessary for rapid loading operations of the cannon 10.

For smooth axial engagement, the axial leading edges 96 of the two mating components 52, 54 face one another. The primary guide faces 82 on either side of the axial leading edges 96 act to guide the engagement of the components 52, 54 and to avoid jamming. At the extreme misalignment for axial engagement, the axial leading edges 96 pass each other so that one gear's primary guiding face 82 slides along the mating gears primary guiding face 82. The clearance chamfer 84 allows for clearance between the next pair of teeth 70 on both the engaging components 52, 54 before the engagement of the primary guide face 82 of the respective components 52, 54.

During axial engagement, when the tooth 70 on the stationary gear type make-break 70 (the driving component 52) is aligned with the center line of the space of the mating moveable gear type make-break 60 (the driven component 54), the moveable mating gear type make-break 60 may be misaligned by an angle half as great as the angular tooth 70 spacing and still self align during coupling engagement. Substantially no orientation of the driven component 54 will allow jamming. For misalignment in excess of half the angular tooth 70 spacing, engagement will simply slip to the next tooth 70.

During axial engagement when the space on the driving component 52 is aligned with the center line of the space of the mating driven component 54, the movable, driven component 54 may be misaligned up to 90 percent of the case noted above and still self align. An amount of misalignment very close to half the angular tooth 70 spacing may allow jamming. When misalignment is 10 percent beyond half the angular tooth spacing, the engagement will slip to the next tooth 70. Such design facilitates the repeatable coupling engagement necessary for rapid firing operations of the cannon 10.

Figure 8:
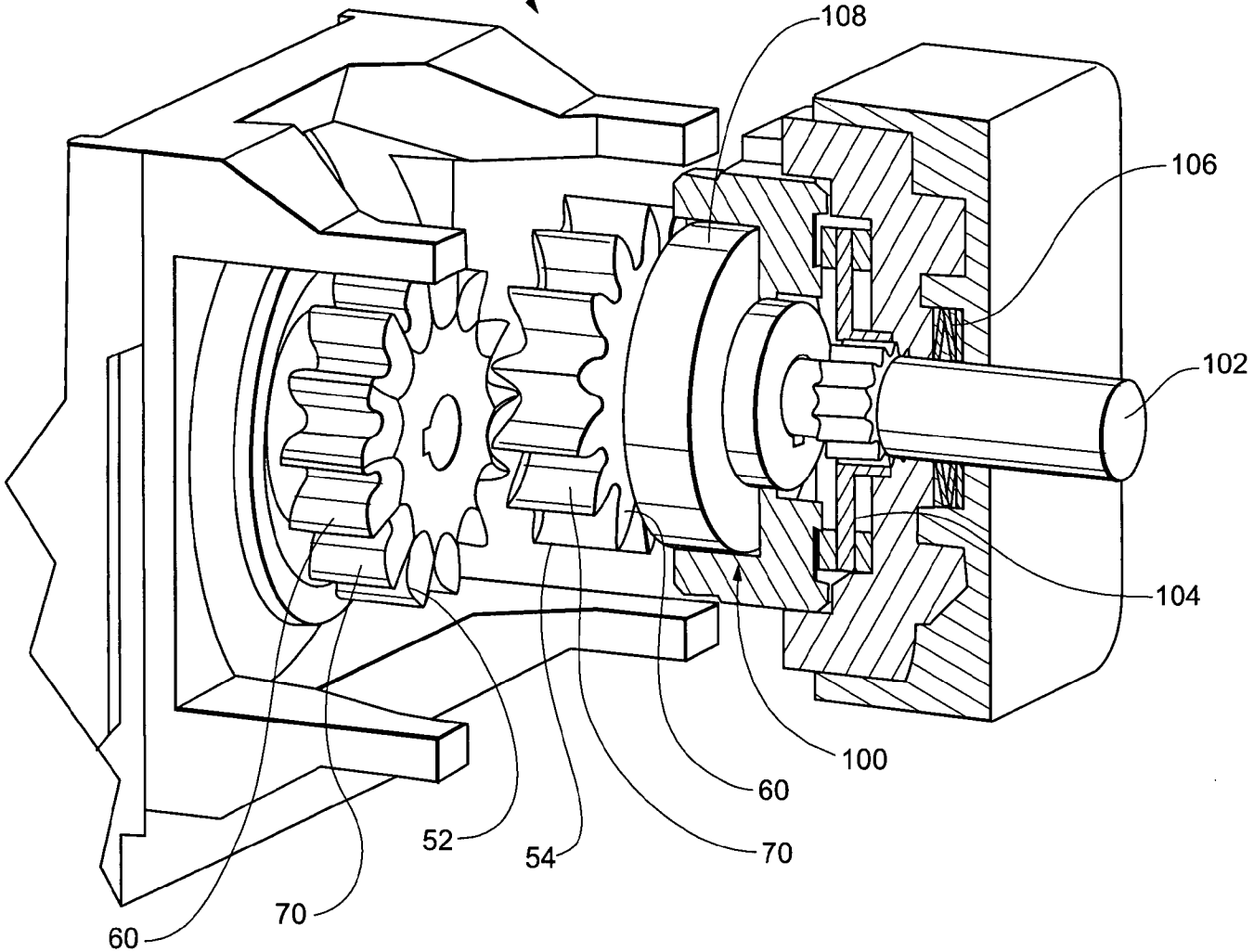
FIG. 8 is a partial sectional view of the break assembly of a driven and driver portions of a make-break device in the disengaged disposition prior to axial engagement.
Figure 9:
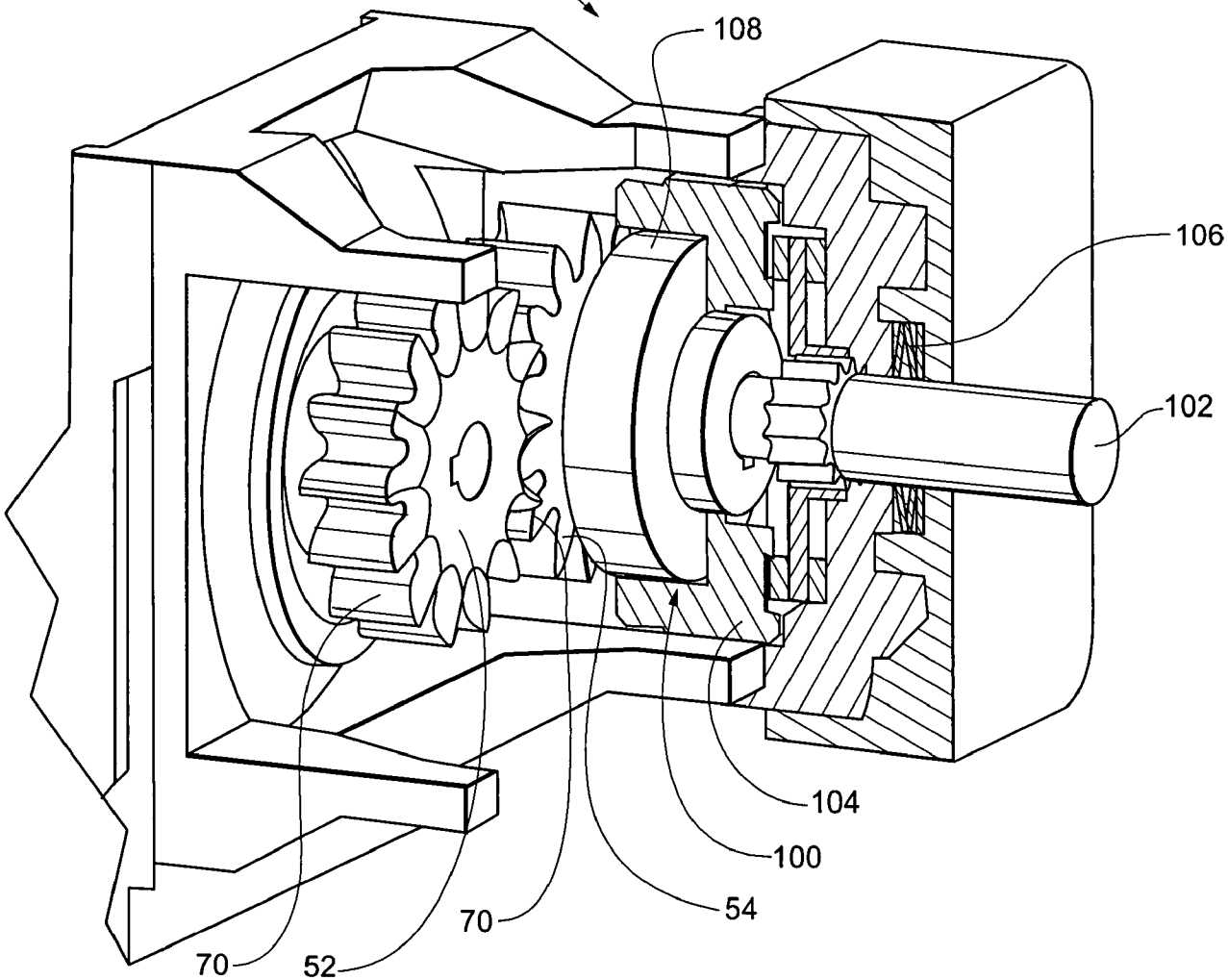
FIG. 9 is a partial sectional view of the break assembly of FIG. 8 in the engaged disposition.
Figure 10:
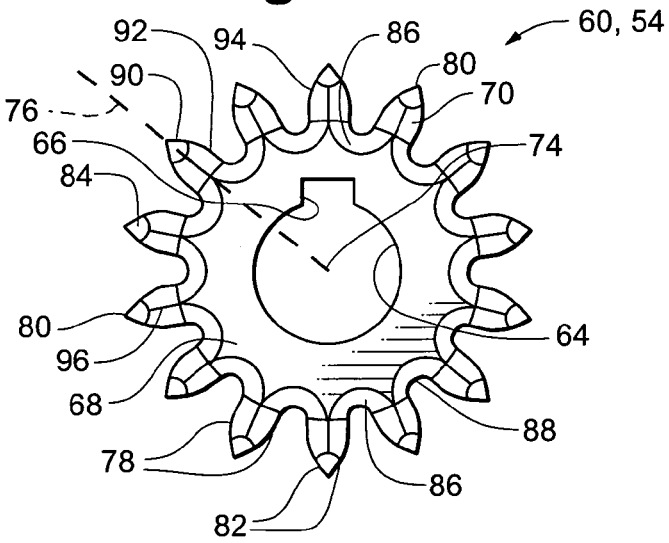
FIG. 10 is an end on elevational view of a gear make-break device.
Figure 11:
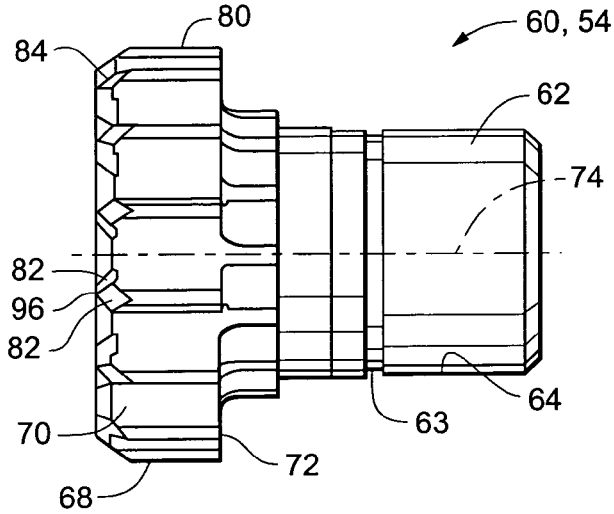
FIG. 11 is a side elevational view of a gear make-break device.
Figure 12:
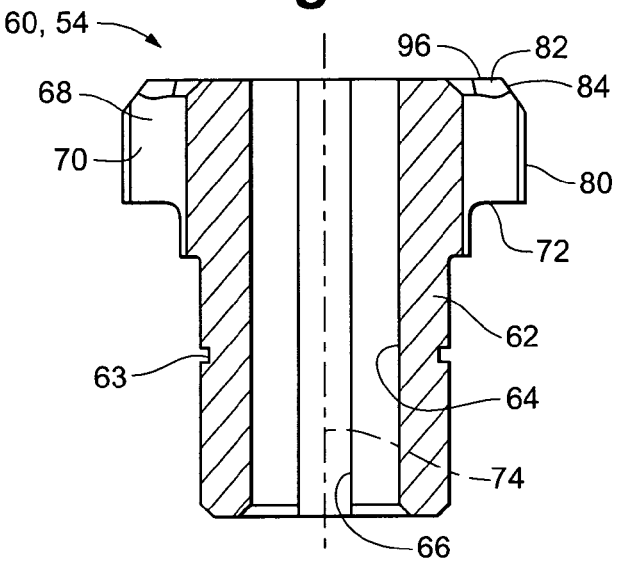
FIG. 12 is a sectional view taken along the section line A-A of FIG. 10.
Figure 13:
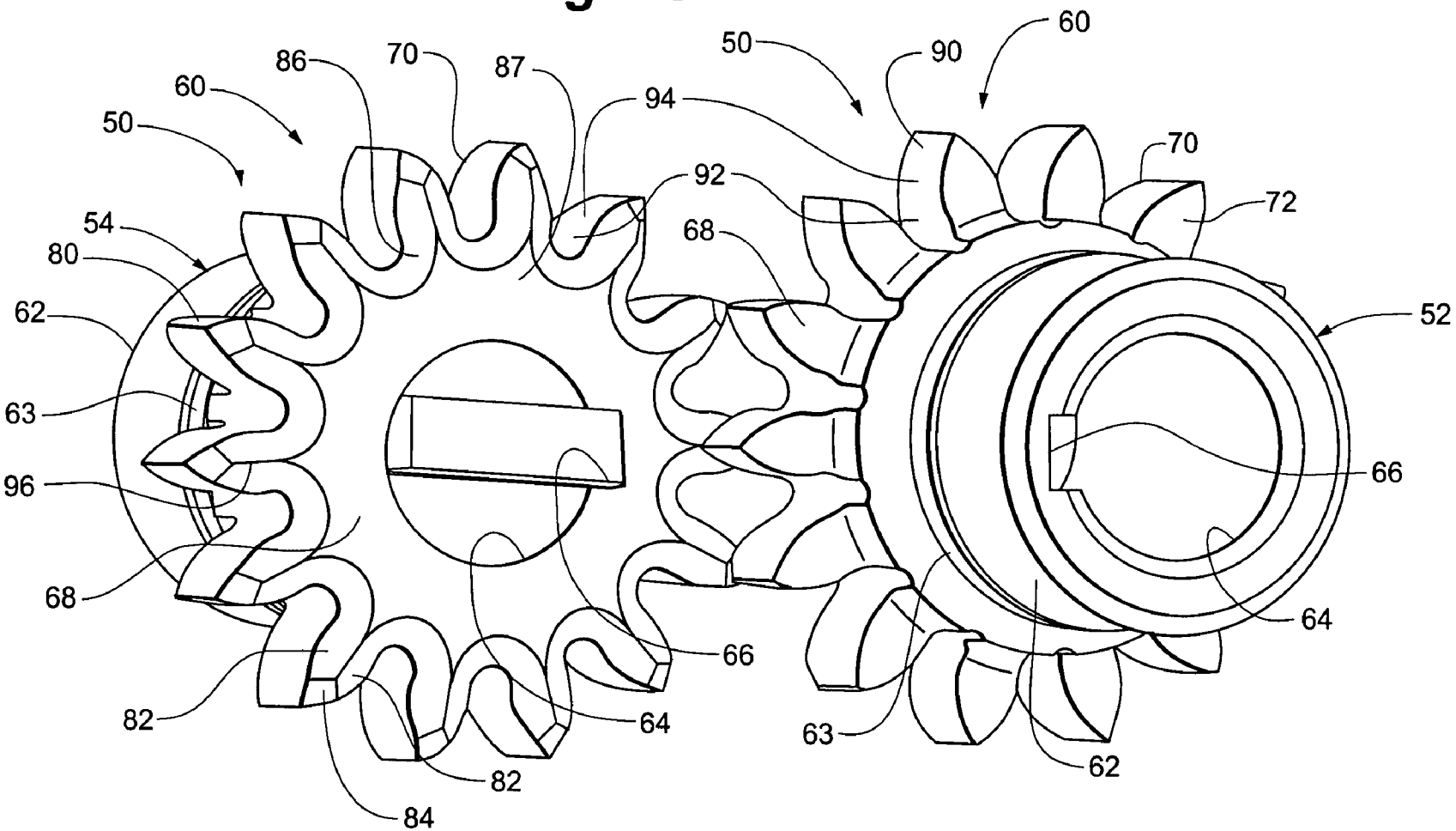
FIG. 13 is a perspective view of tooth to tooth axial presentation of a gear make-break device.
Figure 14:
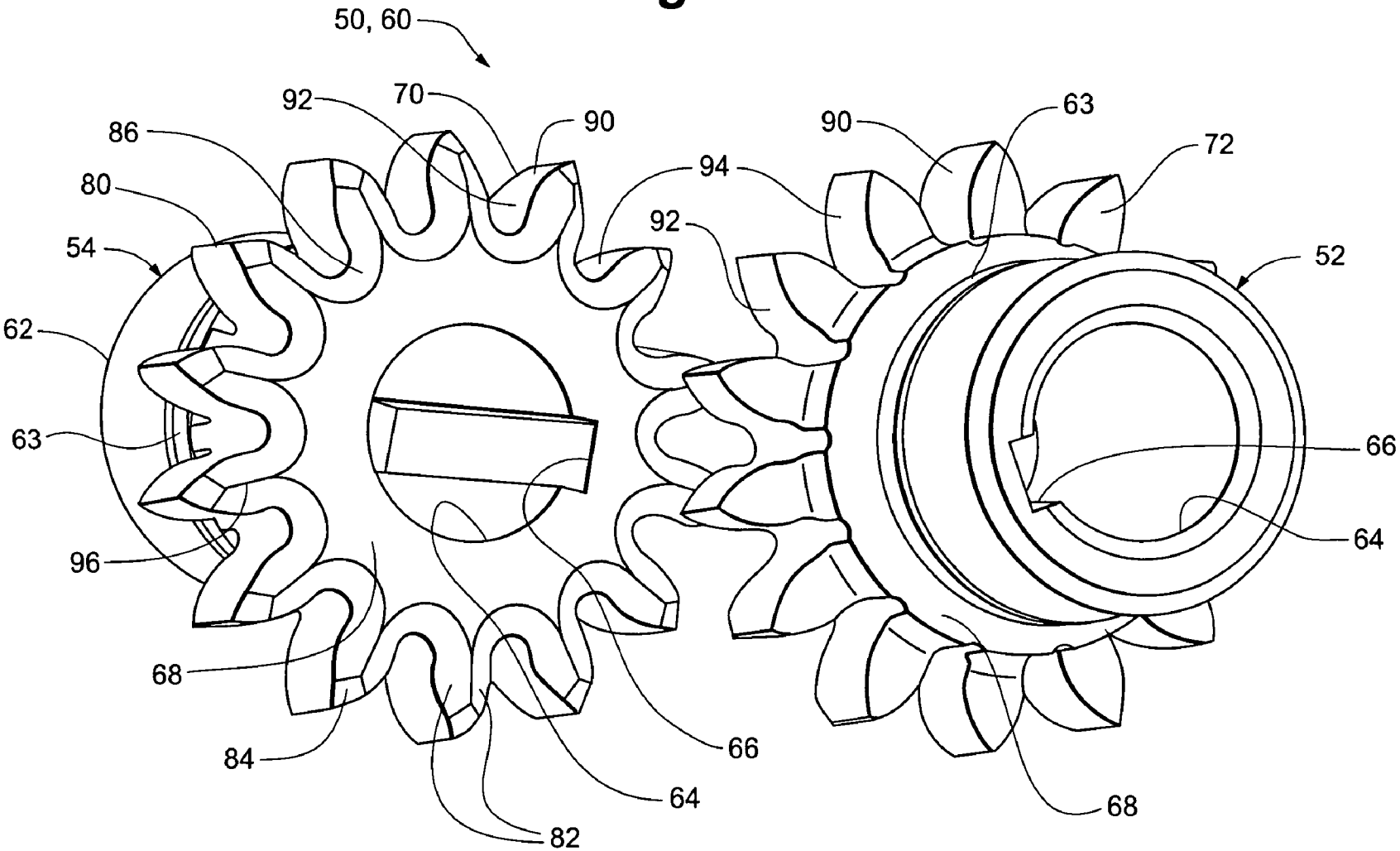
FIG. 14 is a perspective view of space to space axial presentation of a gear make-break device.
Figure 15:
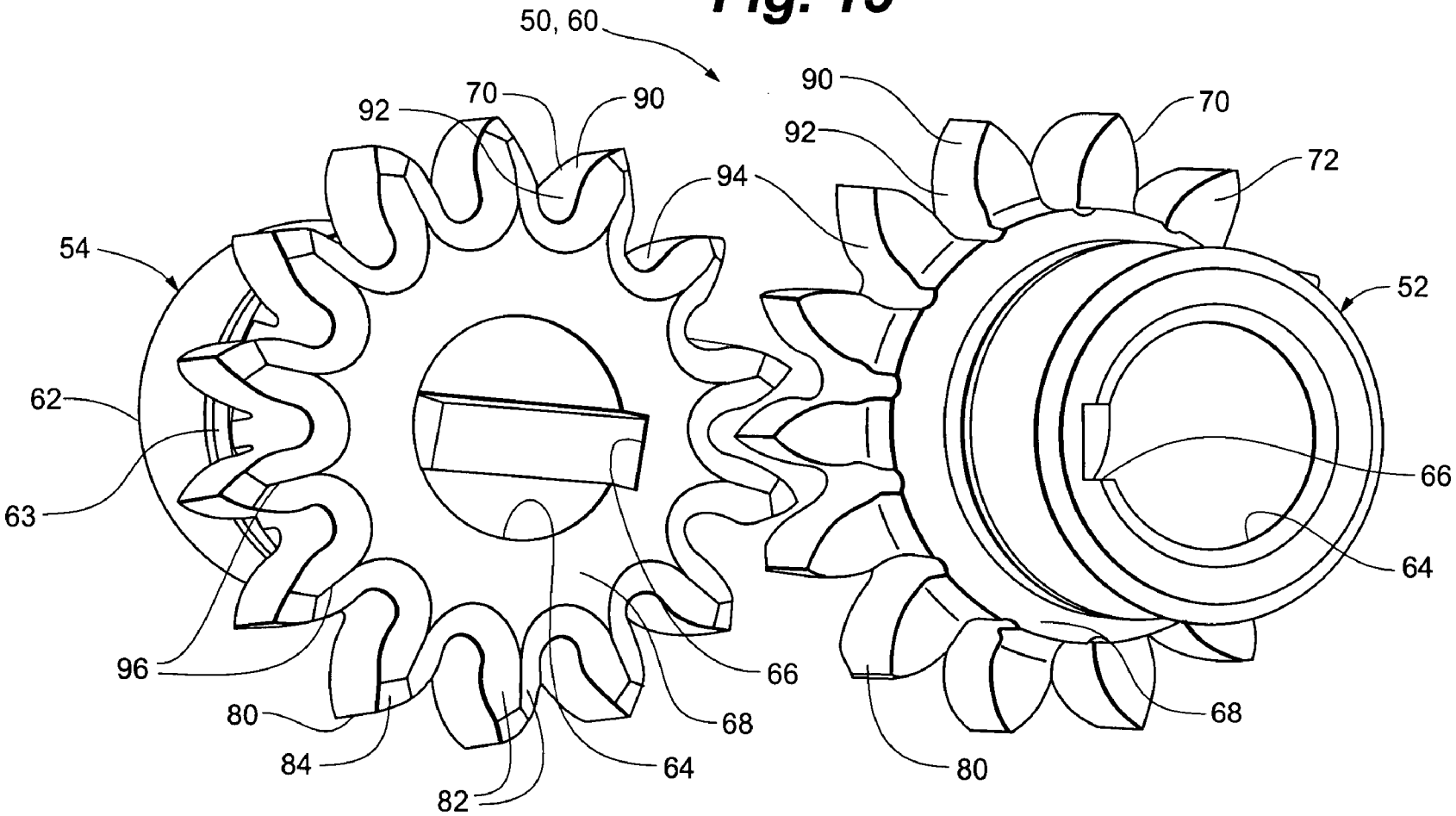
FIG. 15 is a perspective view of the preferred tooth to space axial presentation of a gear make-break device.

Referring to FIGS. 8 and 9, the driven component 54 is operably coupled to a brake 100. The brake 100 is mounted on a centrally disposed splined shaft 102 so that the brake 100 can translate longitudinally with respect to the longitudinal axis of the splined shaft 102. The brake 100 includes a brake pad 104 that is actuated by springs 106. The brake pad 104 acts on the rotor 108 to impede rotation of the driven component 54.

During recoil of the cannon 10, the springs 106 cause the brake pad 104 to come into contact with the rotor 108 thus braking the driven component 54 in order to minimize any misalignment between the driven component 54 and the driving component 52 that may occur during recoil. As the gun is returned to battery at the completion of the recoil motion, the brake 100 is released just prior to coupling engagement of the driven component 54 with the driving component 52. This allows the driven component 54 to rotate relative to the fixed driving component 52 in order that a misalignment between the driven component 54 and the driving component 52 maybe accommodated as noted above the description of the axial engagement of the teeth 70.

Figure 17:
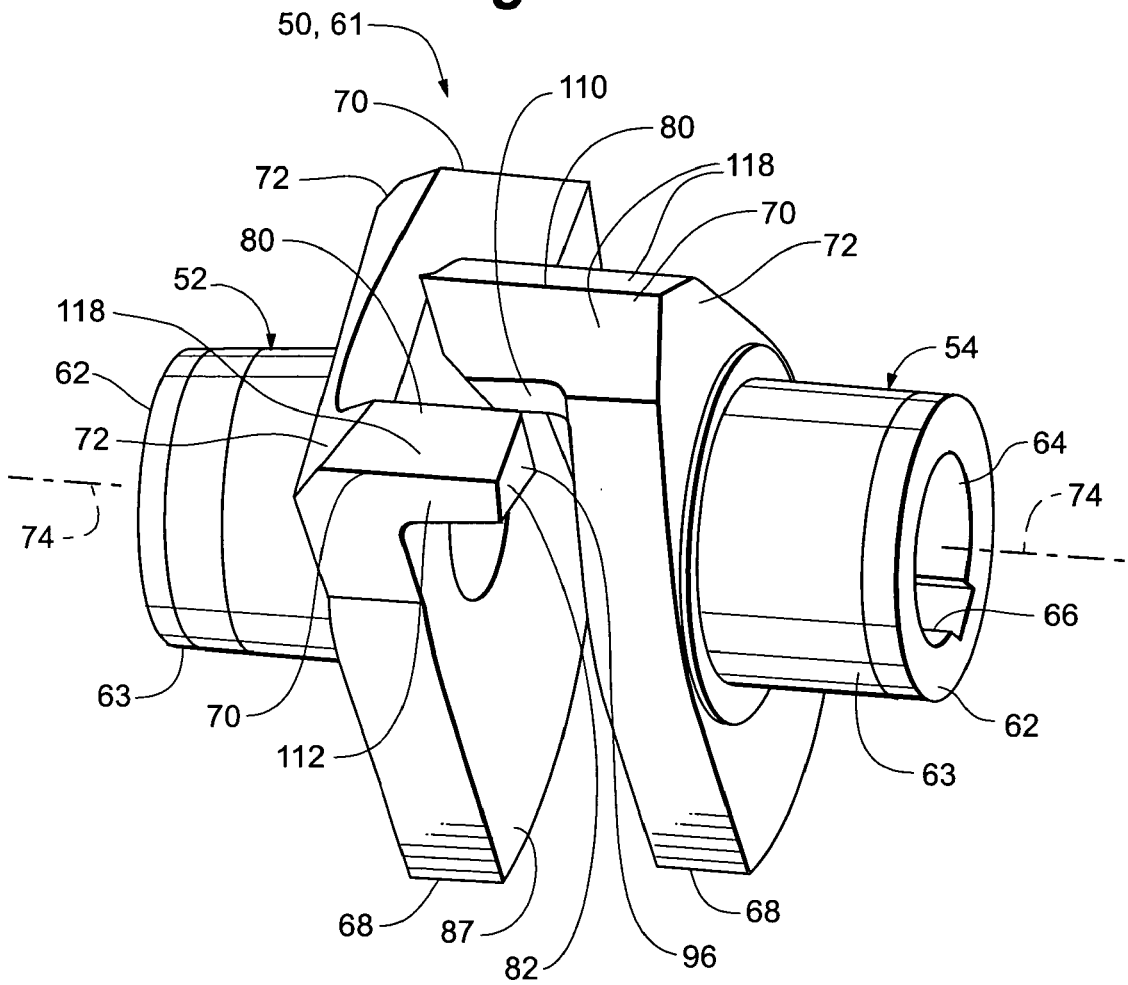
FIG. 17 is a perspective view of both components of a single tang make-break device.

The make-break device 50 depicted in FIGS. 17-24 is a second embodiment of the present invention and is a tang type make-break type device 61. In a preferred embodiment, the driving component 52 (FIGS. 17-20) and the driven component 54 (FIGS. 17 and 21-23) of the tang type make-break device 61 are not identical, the driving component 52 having a pair of spaced apart teeth (tangs) 70 and the driven component 54 having a single tooth (tang) 70 for being drivingly engaged in the space defined between the teeth 70 of the component 52. The tangs 70 of the second embodiment 61 are functionally analogous to the teeth 70 of the first embodiment above and similar structural components are described using analogous reference numerals. With the driving component 52 and the driven component 54 of the tang type make-break device 61, the longitudinal (bore) axes 74 of the components 52, 54 are substantially coincident (axially aligned) when the respective tangs 70 are made or coupled (engaged) as depicted in FIG. 17.

The driving component 52 and the driven component 54 of the tang type make-break device 61 each includes a gear body 62. The gear body 62 has a tubular exterior margin and, in an embodiment, has a circlip groove 63 defined therein. An axial bore 64 extends through the gear body 62. A keyway 66 is defined in the axial bore 64 for coupling the make-break device 61 to respective shafts.

A gear head 68 extends radially outward from the exterior margin of the gear body 62. The gear head 68 of the driving component 52 (FIGS. 17-20) has two spaced-apart teeth (tangs and teeth used herein interchangeably) 70 formed thereon. Each of the teeth 70 project axially forward from the gear head 68 and has a generally rearwardly sloping backside margin 72. The axial leading edge 96 of each of the teeth 70 is radially disposed with respect to a bore axis 74 of the driving component 52. The structure of the teeth 70 of the driving component 52 is assymetrical about a plane including the bore axis 74 and any point along the leading edge 96. The teeth 70 of the driving component 52 are mirror images of one another. Sharp edges 80, 81, and 96 are each flanked by chamfered surfaces; edge 80 by surfaces 118, the opposed edge 81 by surfaces 112, and the orthogonally disposed edge 96 by primary guide faces 82. Edges 80 and 81 are respectivlely presented in both radial directions, e.g. approaching the bore axis 74 and retreating from the bore axis 74 in order to facilitate radial engagement in both direction along a radius of the components 52, 54. Accordingly, component 54 can either radially approach edges 81 of the teeth 70 of component 52 for radial engagement with component 52 or component 54 can radially approach edges 80 of the teeth 70 of component 52 for radial engagement with component 52. Edge 96 is presented orthogonal thereto in order to facilitate axial engagement of the components 52, 54.

The gear head 68 of the driven component 54 (FIGS. 17 and 21-23) has a single tooth (tang) 70 formed thereon. The tooth 70 has a generally rearwardly sloping backside margin 73. The tooth 70 is radially disposed with respect to a bore axis 74 of the driven component 54. The structure of the tooth 70 is preferably symmetrical about a plane including the bore axis 74 and any point along the axial leading edge 96. Sharp edges 80, 81, and 96 are each flanked by chamfered surfaces; edge 80 by surfaces 118, the opposed edge 81 by surfaces 112, and the orthogonal disposed edge 96 by primary guide faces 82. Edges 80 and 81 are respectively presented in both radial directions (as described above with reference to component 52) to minimize the effect of any misalignment that may exist between components 52, 54 and to maximize the possibility of radial and axial engagement of the two teeth 70 of the driving component 52 with the tooth 70 of the driven component 54, as is discussed in greater detail below.

As noted above, each of the teeth 70 of both the driving component 52 and the driven component 54 has an outer radial leading edge 80. The outer radial leading edge 80 is flanked by radial primary guide faces 118 on either side thereof that are chamfered with respect to the radial leading edge 80. In a preferred embodiment, the radial primary guide faces 118 are flat faces.

Further, each of the teeth 70 of both the driving component 52 and the driven component 54 has an inner radial leading edge 81. The inner radial leading edge 81 is flanked by radial secondary guide faces 112 on either side thereof that are chamfered with respect to the inner radial leading edge 81. In a preferred embodiment, the radial secondary guide faces 112 are flat faces.

A clearance chamfer 84 extends outward from the maximum radial point of the axial leading edge 96 at a rearward directed angle on each tang 70 of both components 52, 54. The clearance chamfer 84 in a preferred embodiment forms a rectangle that may be diamond shaped. A secondary clearance chamfer 85 extends inward from the minimum radial point of the radius leading edge 96 at a rearward directed angle on each tang 70 of both components 52, 54. The clearance chamfer 85 in a preferred embodiment forms a rectangle that may be diamond shaped. In the preferred embodiment, the clearance chamfers 84, 85 are flat surfaces, but curved surfaces could be employed as well. The clearance chamfers 84, 84 allow for clearance between the teeth 70 on both the engaging components 52, 54 before the engagement of the primary guide face 82 of the respective components 52, 54.

Figure 21:
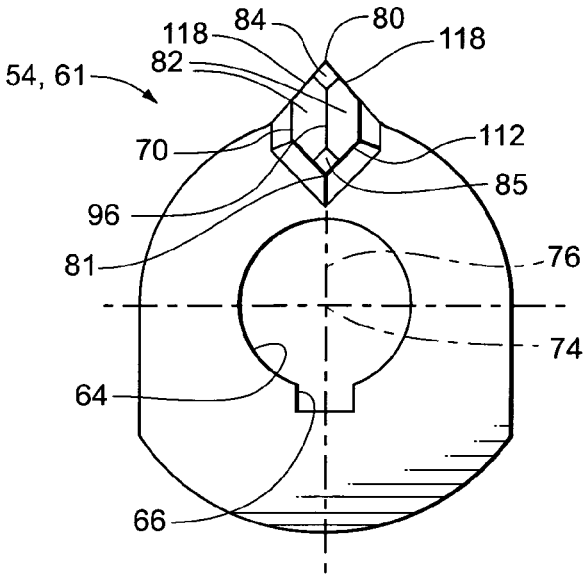
FIG. 21 is an end on elevational view of the driven component of a tang make-break device.
Figure 22:
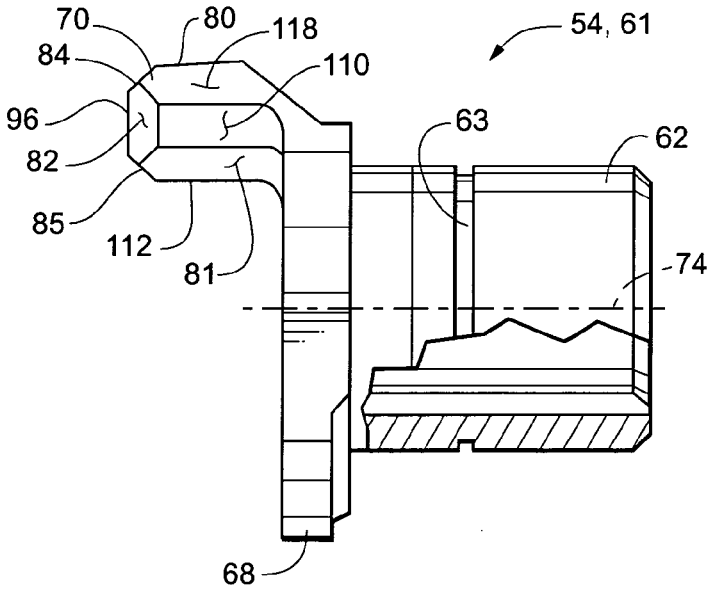
FIG. 22 is a side elevational view of the driven component of a tang make-break device.
Figure 23:
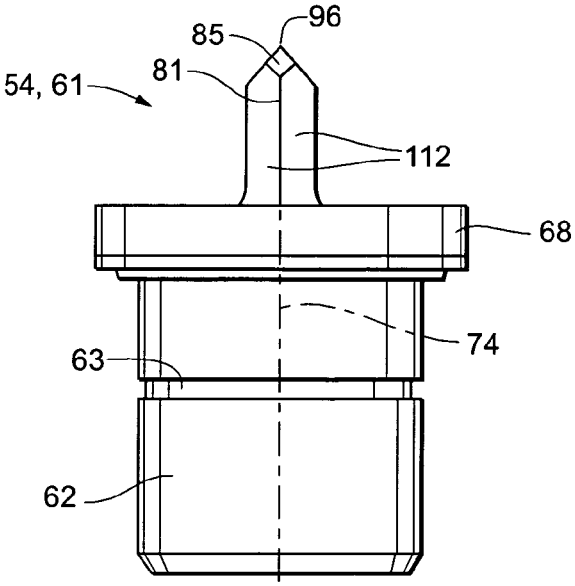
FIG. 23 is a bottom elevational view of the driven component of a tang make-break device.
Figure 24:
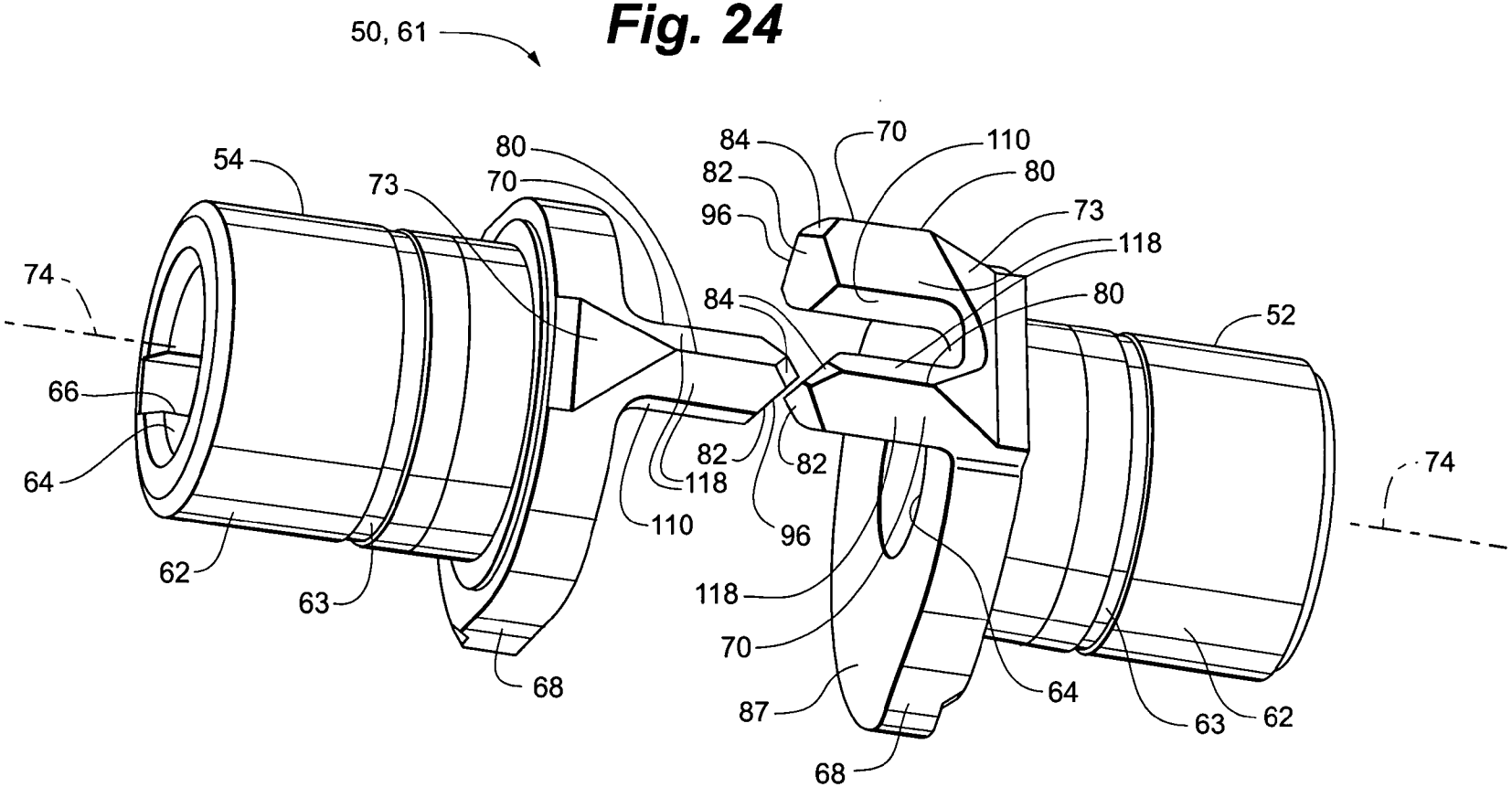
FIG. 24 is a perspective view of tooth to tooth axial presentation of a tang make-break device.

Rotational driving in either rotational direction through the joint effected between the two teeth 70 of component 52 and the tooth 70 of component 54 (FIG. 17) is effected through the interaction of the primary bearing surface 110 of a certain one of the two teeth 70 of component 52 and a certain one of the bearing surfaces 110 of the tooth 70 of component 54. On driving component 52, bearing surfaces 110 are preferably flat and in opposing inward directed parallel disposition. Preferably, bearing surfaces 110 are not radial surfaces. One inward directed bearing surface 110 is on each tang 70. On driven component 54, there are two outward directed bearing surfaces 110 disposed on opposite sides of the tang 70. The surfaces 110 are parallel and not radial, as depicted in FIGS. 21-23.

When driving through the tang joint in the primary mode of operation (the tang joint being the disposition with the tang 70 of the driven component 54 disposed inside the space defined between the two tangs 70 of the driving component 52 as depicted in FIG. 17 and the two axes 74 coincident), surface 110 of one tooth 70 of driving component 52 will contact the adjacent surface 110 of the tooth 70 of the driven component 54, as a function of the direction of rotation. The non-bearing surface 110 of the other tooth 70 of driving component 52 will be slightly spaced apart from the adjacent, opposing surface 110 of the tooth 70 of the driven component 54. This is the desired primary drive orientation with minimal backlash. Driving is in either rotational direction as desired.

At extreme misalignment for proper axial engagement (FIG. 24), edge 96 of tooth 70 of driven component 54 will be slightly offset from edge 96 of driving component 52. Both edges 96 are radial to the joint centerlines 74 of the respective component 52, 54 so any jamming of the edges 96 is minimal and only occurs with parallel misalignment of the joint axes 74 of the respective components 52, 54. During engagement, face 82 of driven component 54 will slide past the inward directed face 82 of driving component 52 and the teeth 70 of the respective components 52, 54 will slide into driving engagement as depicted in the joint of FIG. 17. During missing engagement, face 82 of a certain tooth 70 of driven component 52 will slide past face 82 of the driven component 54, thereby placing face 112 of component 52 alongside face 110 of the certain tooth 70 of component 52 in driving engagement. In a preferred embodiment, joint geometry allows an error of approximately ±20 degrees of misalignment between components 52 and 54 for make.

Figure 18:
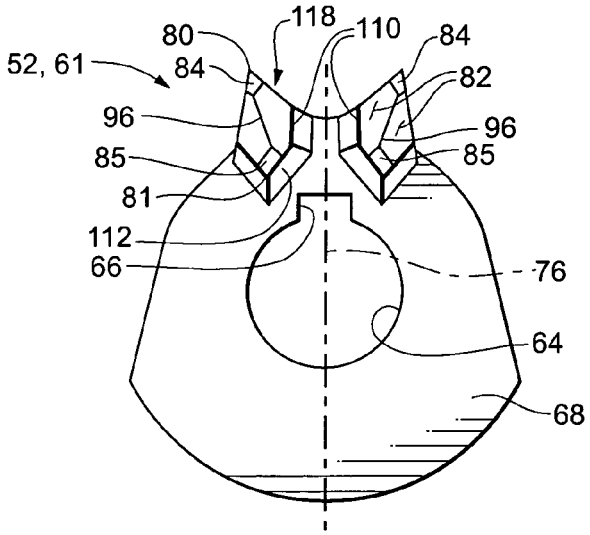
FIG. 18 is an end on elevational view of the driving component of a tang make-break device.
Figure 19:
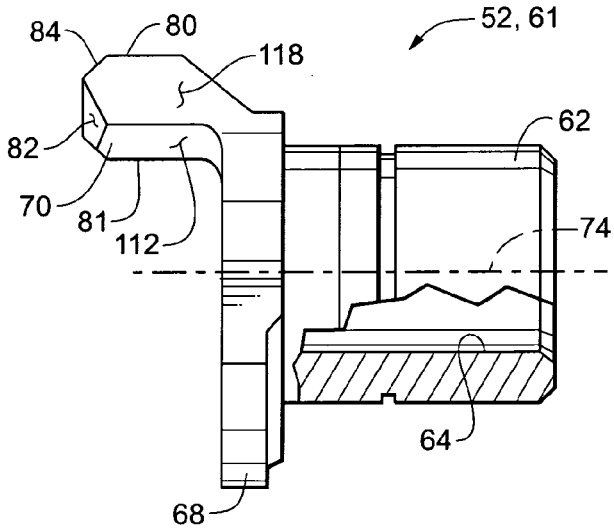
FIG. 19 is a side elevational view of the driving component of a tang make-break device.
Figure 20:
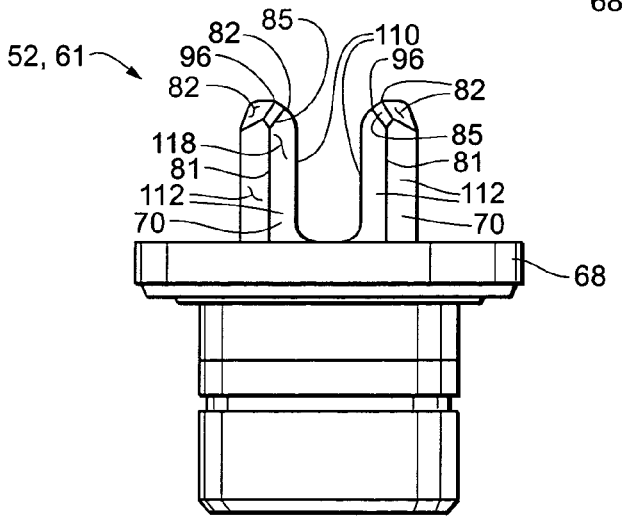
FIG. 20 is a bottom elevational view of the driving component of a tang make-break device.

At extreme misalignment for proper radial engagement on the near side of the joint axis edge 80 of a tooth 70 of driving component 52 will be slightly offset from edge 81 of the tooth 70 of the driven component 54. During engagement, face 112 of driven component 54 will slide on the inside of edge 80, toward face 120 (FIG. 18). During missed engagement, face 112 (mirror) of the driven component 54 will slide on the outside of edge 80, toward face 118, and eventually the tang will slide on face 118. The joint (the meshed engagement of the tangs 70 of the components 52, 54, as depicted in FIG. 17) geometry allows an angular error on the double tang 70 driving component 52 of approximately ±18 degrees to engage properly in the primary mode of operation.

At extreme misalignment for proper radial engagement on the far side of the joint axis 74, edge 81 of a certain tooth 70 of driving component 52 will be slightly offset from edge 80 of the tooth 70 of the driven component 54. During engagement, edge 80 of the tooth 70 of the driven component 54 will slide on the inward directed edge 112 of a certain tooth 70 of the driving component 52. During missed engagement, the face 118 of the tooth 70 of the driven component 54 will slide on edge 81 of a certain tooth 70 of the driving component 52. An exemplary joint geometry allows an angular error on double tang 70 driving component 52 of approximately +/−26 degrees to engage properly in the primary mode of operation.

If the joint between components 52, 54 does not engage properly, the tang type make-break device 61 will still transmit torque, but the alignment will be in the secondary orientation and backlash may be about 280 degrees. When the joint misaligns during engagement, surface 112 of a respective tooth 70 of the driving component 52 will drive against an adjacent surface 110 of the tooth 70 of the driven component 54 (mirror image assumed when appropriate). Driving in the opposite rotation operates identically except that mirrored faces 110, 112 of the respective tangs 70 are in contact.

As noted above, each of the tangs 70 on driving component 52 also includes a non-radial, bearing surface 112 (the outward directed one of the two chamfered surfaces 112 that flank the edge 81). In the event that the tang 70 of the driven component 54 slides to the outside of either tang 70 on the driving component 52, one of the bearing surfaces 110 of the tang 70 of the driven component 54 will be in engaging, parallel, bearing disposition with a respective secondary bearing surface 112 on the adjacent tang 70 of the driving component 52. Driving in either rotational direction may be effected in the secondary mode of operation, i.e. with the tang 70 of the driven component 54 outside the space defined between the two tangs 70 of the driving component 52, although a rotation of the driven component 54 about 280 degrees relative to the driving component 52 may be required to bring the bearing surface 110 of the driven component into engagement with the required bearing surface 112 of the component 52 for the desired direction of rotational motion.

What is claimed is:

1. A cannon having orthogonally acting operations, including axial firing recoil operations and transverse ammunition loading/unloading and locking/unlocking operations, comprising:

at least one stationary electric drive motor assembly;

at least one shiftable driven assembly; and a make-break device selectively coupling the at least one stationary electric drive motor assembly to the at least one shiftable driven assembly, the make-break device being selectively couplable and uncouplable during both the axial and transverse operations.

2. The cannon of claim 1 wherein the make-break device comprises;

a first component having at least one engaging member, the engaging member presenting first and second orthogonally disposed edges, each edge being defined at the intersection of a respective pair of chamfered faces;

a second component having at least one engaging member, the engaging member presenting first and second orthogonally disposed edges, each edge being defined at the intersection of a respective pair of chamfered faces, where the first component first edge and the second component first edge cooperatively act to assist in facilitating radial meshing engagement of the first and second components and where the first component second edge and the second component second edge cooperatively act to assist in facilitating axial meshing engagement of the first and second components.

3. The cannon of claim 2, the first and second components each having a respective longitudinal axis, the respective first edges being disposed parallel to the respective longitudinal axes and the respective second edges being disposed radial to the respective longitudinal axes.

4. The cannon of claim 2, the first and second components being axially aligned when in meshing engagement.

5. The cannon of claim 2, the first and second components being axially displaced when in meshing engagement.

6. The cannon of claim 2, a chamfered face being defined between an end of the first edge and end of the second edge of the engaging member of the respective first and second components.

7. The cannon of claim 2, the first and second components each being a gear, the engaging member thereof being a plurality of teeth.

8. The cannon of claim 7, each tooth of the first and second components having an increased addendum to effect smooth radial engagement of the first and second components.

9. The cannon of claim 7, each tooth of the first and second components having a decreased dedendum diameter to minimize interference at a tooth root.

10. The cannon of claim 2, the respective pair of chamfered faces defining the respective first edges of the first and second components being involute surfaces, engageable when the first and second components are in meshed engagement.

11. The cannon of claim 2, the first component engaging member thereof being a pair of spaced apart, axially extending tangs and the second component engaging member thereof being an axially extending tang for engagement in the space defined between the first component engaging member pair of tangs.

12. In a cannon, a method of selectively coupling/decoupling respective stationary electric drive assemblies from associated shiftable driven assemblies during orthogonal cannon operations, comprising;

selectively coupling a stationary electric drive assembly to an associated shiftable driven assembly by means of an interposed make-break device; and selectively coupling and uncoupling the make-break device during both the axial and transverse cannon operations for selectively coupling and uncoupling the stationary electric drive assembly and the associated shiftable driven assembly.

13. The method of claim 12 further including;

forming a first make-break device component having at least one engaging member;

presenting first and second engaging member orthogonally disposed edges, each edge being defined at the intersection of a respective pair of chamfered faces;

forming a second make-break device component having at least one engaging member;

presenting first and second orthogonally disposed edges on the second make-break device component engaging member, each edge being defined at the intersection of a respective pair of chamfered faces; and cooperatively acting the first component first edge and the second component first edge to assist in facilitating radial meshing engagement of the first and second components and cooperatively acting the first component second edge and the second component second edge to assist in facilitating axial meshing engagement of the first and second components.

14. The method of claim 13, including disposing the respective first edges parallel to respective first and second component longitudinal axes and disposing the respective second edges radial to the respective first and second component longitudinal axes.

15. The method of claim 13, including axially aligning the first and second components when in meshing engagement.

16. The method of claim 13, including axially displacing the first and second components when in meshing engagement.

17. The method of claim 13, including defining a chamfered face between an end of the first edge and end of the second edge of the engaging member of the respective first and second components.

18. The method of claim 13, including forming the first and second components each as a gear and forming the engaging member thereof as a plurality of teeth.

19. The method of claim 18, including increasing the addendum of each tooth of the first and second components to effect smooth radial engagement of the first and second components.

20. The method of claim 18, including decreasing the dedendum diameter of each tooth of the first and second components to minimize interference at a toot root.

21. The method of claim 13, including forming the respective pair of chamfered faces defining the respective first edges of the first and second components as involute surfaces and engaging the involute surfaces when the first and second components are in meshed engagement.

22. The method of claim 13, including forming the first component engaging member thereof as a pair of spaced apart, axially extending tangs and forming the second component engaging member thereof as an axially extending tang for engagement in the space defined between the first component engaging member pair of tangs.

* * * * *